US010501303B2

(12) United States Patent
Lee et al.

(10) Patent No.: US 10,501,303 B2
(45) Date of Patent: Dec. 10, 2019

(54) DRINKING WATER SUPPLY DEVICE AND METHOD OF CONTROLLING THE SAME

(71) Applicant: LG ELECTRONICS INC., Seoul (KR)

(72) Inventors: Myounghoon Lee, Seoul (KR); Jinpyo Hong, Seoul (KR); Kiwon Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/757,742

(22) PCT Filed: Jul. 19, 2016

(86) PCT No.: PCT/KR2016/007845
§ 371 (c)(1),
(2) Date: Mar. 6, 2018

(87) PCT Pub. No.: WO2017/052052
PCT Pub. Date: Mar. 30, 2017

(65) Prior Publication Data

US 2019/0047837 A1 Feb. 14, 2019

(30) Foreign Application Priority Data

Sep. 23, 2015 (KR) ..... 10-2015-0134386

(51) Int. Cl.
*B67D 1/00* (2006.01)
*B67D 1/12* (2006.01)
(Continued)

(52) U.S. Cl.
CPC ..... *B67D 1/0036* (2013.01); *B67D 1/004* (2013.01); *B67D 1/0043* (2013.01);
(Continued)

(58) Field of Classification Search
CPC .. B67D 1/0036; B67D 1/0004; B67D 1/0043; B67D 1/0046; B67D 1/0895; B67D 1/1213; B67D 1/1234
(Continued)

(56) References Cited

U.S. PATENT DOCUMENTS 3,375,913 A * 4/1968 Norris, Jr. ..... G07F 13/00 194/240
2003/0234212 A1* 12/2003 Ito ..... C02F 1/46114 210/85
(Continued)

FOREIGN PATENT DOCUMENTS

JP 5034592 9/2012
KR 10-1069263 10/2011
(Continued)

OTHER PUBLICATIONS

PCT International Search Report dated Oct. 14, 2016 issued in Application No. PCT/KR2016/007845.

*Primary Examiner* — Jeremy Carroll
(74) *Attorney, Agent, or Firm* — KED & Associates, LLP

(57) ABSTRACT

A method of controlling a drinking water supply device includes inputting a water discharge signal through an input lever, opening a first valve such that drinking water flows through a first channel and measuring the amount of drinking water flowing through the first channel using a flow rate sensor, opening a second valve for a predetermined time to discharge minerals when the amount of drinking water measured by the flow rate sensor reaches a first predetermined amount, and, opening the second valve again for the predetermined time to further discharge minerals when a second predetermined amount of drinking water is measured by the flow rate sensor.

9 Claims, 5 Drawing Sheets

(51) Int. Cl.
*B67D 1/08* (2006.01)
*B67D 1/04* (2006.01)

(52) U.S. Cl.
CPC ..... *B67D 1/0046* (2013.01); *B67D 1/0895* (2013.01); *B67D 1/1213* (2013.01); *B67D 1/1234* (2013.01); *B67D 2001/0098* (2013.01); *B67D 2001/0493* (2013.01); *B67D 2210/00005* (2013.01); *B67D 2210/00007* (2013.01); *B67D 2210/00036* (2013.01)

(58) Field of Classification Search
USPC ..... 222/640
See application file for complete search history.

(56) References Cited

U.S. PATENT DOCUMENTS

| | | | | |
|---|---|---|---|---|
| 2006/0115570 | A1* | 6/2006 | Guerrero | B67D 1/0027 426/590 |
| 2007/0199582 | A1* | 8/2007 | Kroon | B67D 1/0009 134/56 R |
| 2008/0022694 | A1 | 1/2008 | Anderson et al. | |

FOREIGN PATENT DOCUMENTS

| | | |
|---|---|---|
| KR | 10-2013-0062010 | 6/2013 |
| KR | 10-1521223 | 5/2015 |

* cited by examiner

[Fig. 1]
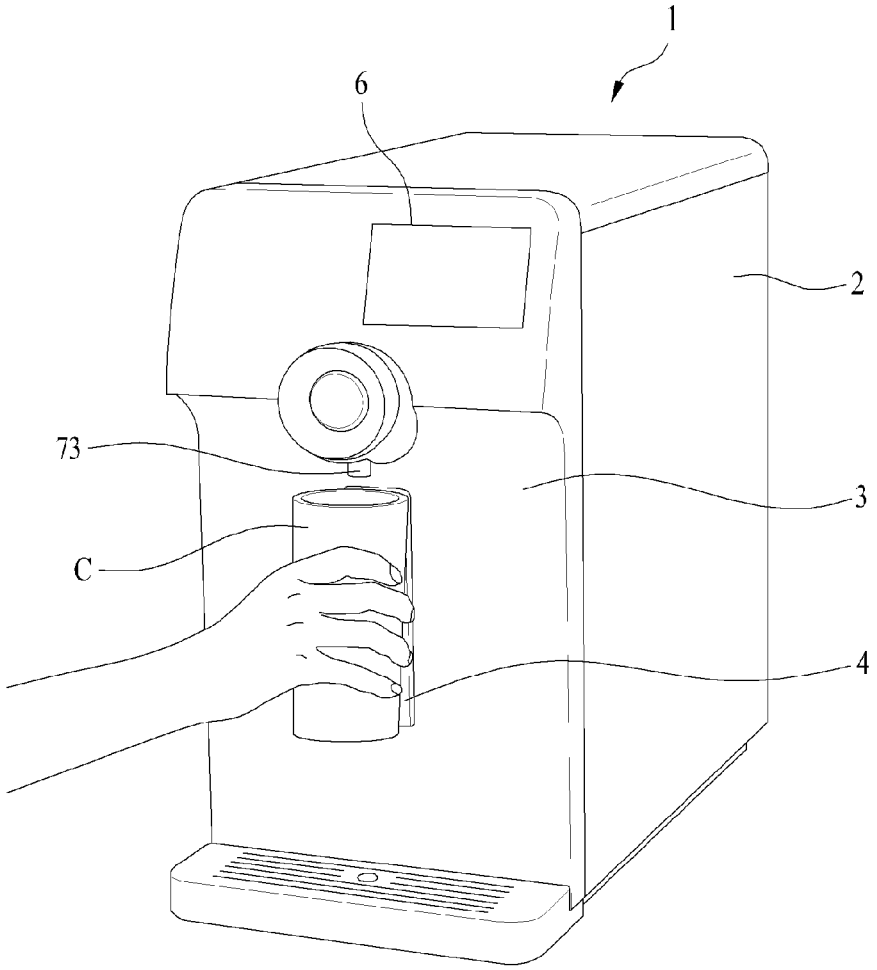

[Fig. 2]
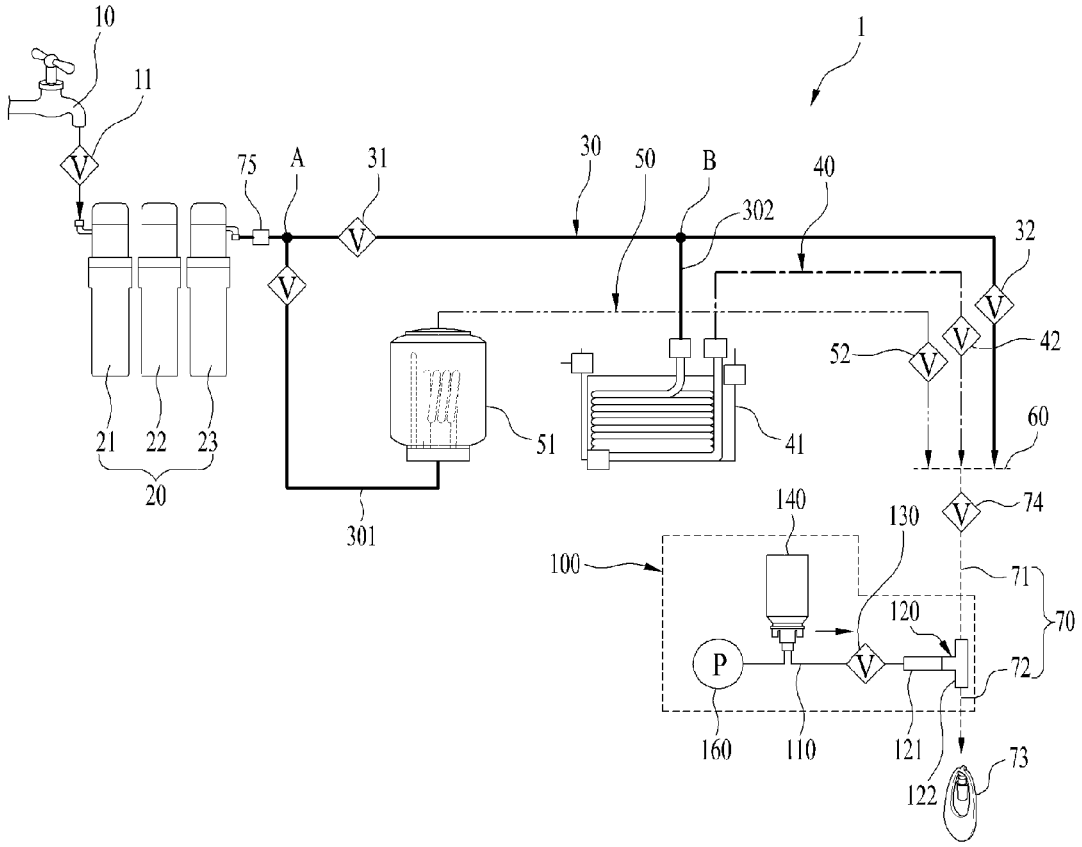
[Fig. 3]
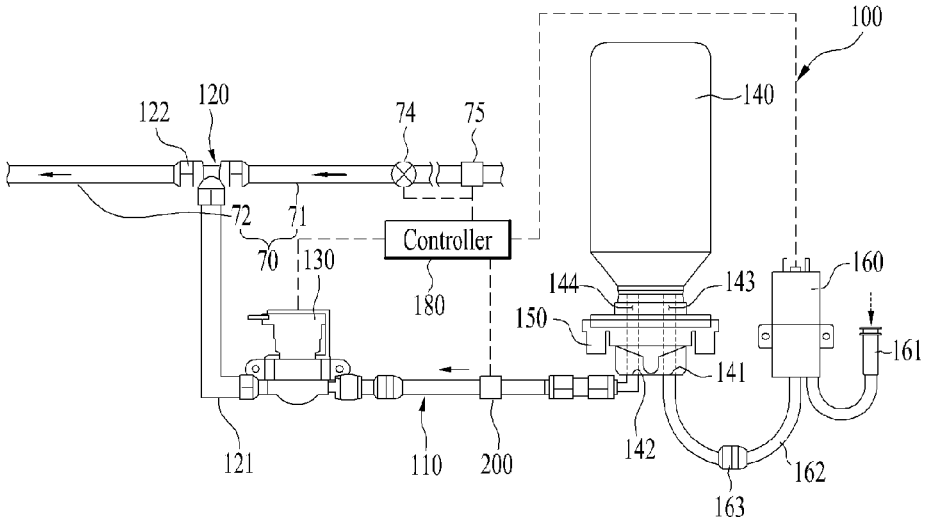

[Fig. 4]
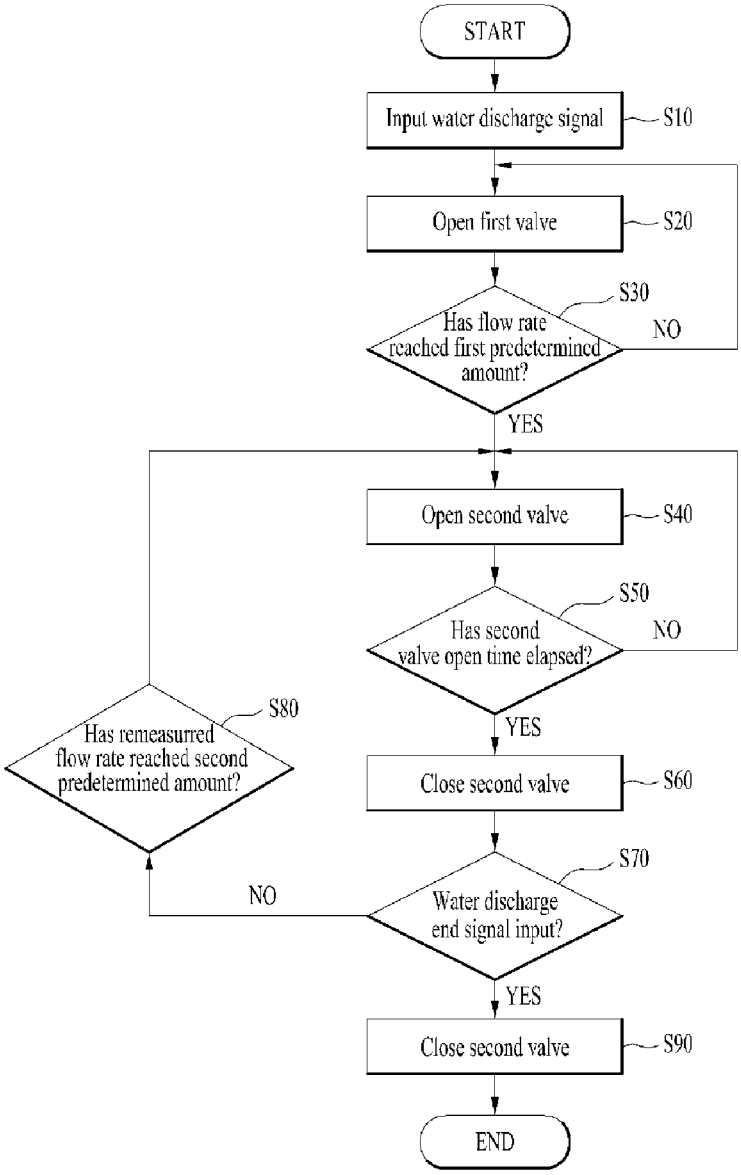

[Fig. 5]
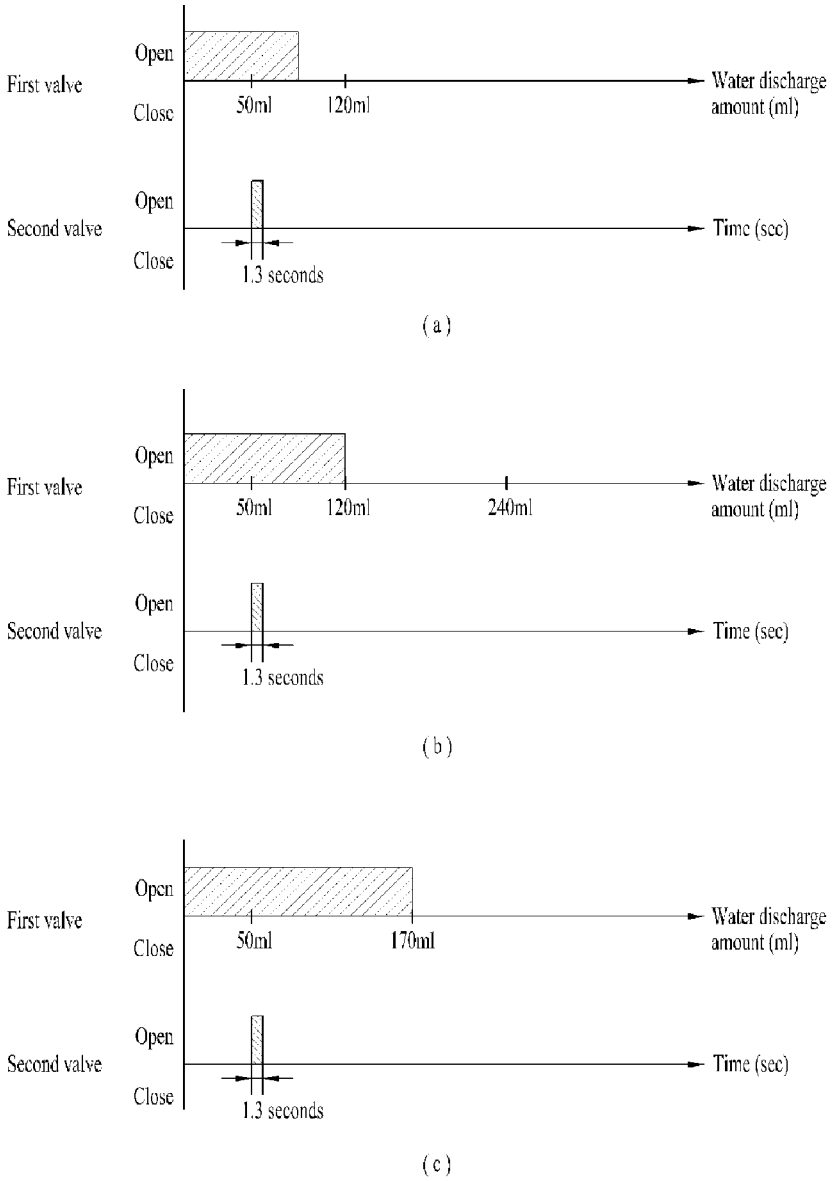

[Fig. 6]
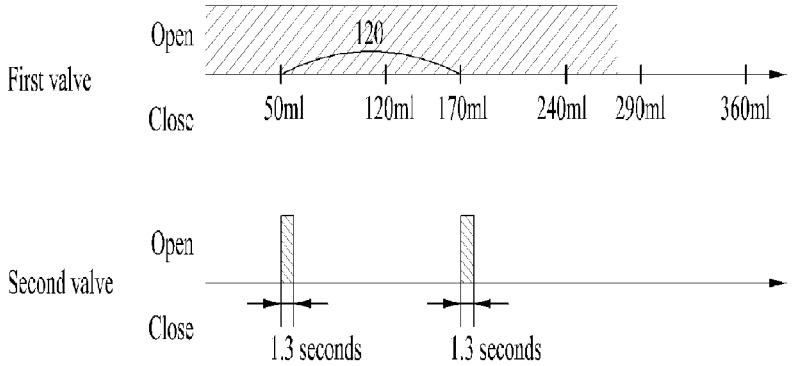
(a)
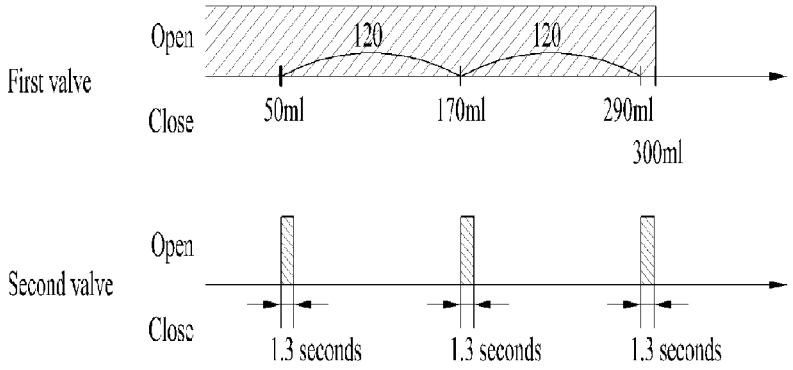
(b)

DRINKING WATER SUPPLY DEVICE AND METHOD OF CONTROLLING THE SAME

CROSS-REFERENCE TO RELATED APPLICATIONS

This application is a U.S. National Stage Application under 35 U.S.C. § 371 of PCT Application No. PCT/KR2016/007845, filed Jul. 19, 2016, which claims priority to Korean Patent Application No. 10-2015-0134386, filed Sep. 23, 2015, whose entire disclosures are hereby incorporated by reference.

TECHNICAL FIELD

The present invention relates to a drinking water supply device that is capable of supplying mineral water and a method of controlling the same, and more particularly to a drinking water supply device that is capable of stably mixing mineral with drinking water to provide water having a uniform taste and a method of controlling the same.

BACKGROUND ART

In general, a drinking water supply device is a device that supplies drinking water to a user. The drinking water supply device may be a stand-alone device, or may constitute part of an electric home appliance, such as a refrigerator.

The drinking water supply device may supply drinking water at room temperature to a user. In addition, the drinking water supply device may cool drinking water flowing therein using a cold water supply unit including a refrigeration cycle, or may heat the drinking water using a heater. That is, the drinking water supply device may supply cold water or hot water to the user as needed.

Drinking water may be underground water, raw water supplied from a faucet, or clean water obtained by filtering raw water supplied from the faucet using an additional filtering means, such as a filter. In the following description, however, drinking water will be defined as drinkable water. That is, drinking water is not limited to the above-mentioned kinds of water.

In recent years, there have been developed drinking water supply devices that are capable of providing functional water satisfying various demands of users in addition to the provision of filtered clean water, cold water, or hot water to users. For example, the drinking water supply device may include a mineral supply module in order to provide mineral water, which contains a predetermined amount of minerals, to a user.

Together with protein, fat, carbohydrates, and vitamins, minerals constitute the five types of nutritional substances. Minerals are known to play an important part in biochemical activity (e.g. catalytic activity) in the human body and in the constitution of the bones, teeth, etc.

In particular, calcium (Ca), potassium (K), magnesium (Mg), and sodium (Na) are mineral elements requisite for metabolism although it is sufficient to supply a very small amount of these mineral elements to the human body Mineral water, which contains such minerals, may play a supporting role in improving a user's health, such as discharging waste matter from the human body and promoting digestion.

In the case in which a predetermined amount of minerals are contained in drinking water, the water may taste better to a user than when the user drinks drinking water. In order to generate such mineral water, mineral supply modules, such as an electro-analyzer, a mineral filter, and a device for directly supplying condensed minerals to clean water, may be installed in the drinking water supply device.

In order to directly supply condensed minerals to clean water, it is necessary to provide a mineral container for storing condensed minerals and a mineral supply line connected between the mineral container and a drinking water supply line for adding the condensed minerals to drinking water. Meanwhile, the drinking water supply device may have a quantitative control mode, in which a predetermined amount of drinking water is supplied to a user, and a real time control mode, in which a desired amount of drinking water is supplied to the user in real time.

That is, in the quantitative control mode, the user may input a command through a quantitative control input unit provided in the drinking water supply device such that the drinking water supply device supplies a predetermined amount of drinking water to the user. On the other hand, in the real time control mode, the user may manipulate a drinking water discharge button or lever provided in the drinking water supply device, instead of inputting a command through the quantitative control input unit, such that the drinking water supply device supplies a desired amount of drinking water to the user in real time. In the real time control mode, however, it is not possible to determine how much water the user will discharge, with the result that it is difficult to determine when and how much minerals will be provided to water that the user will discharge.

DISCLOSURE

Technical Problem

An object of the present invention devised to solve the problem lies on a drinking water supply device that is capable of supplying mineral water containing a uniform ratio of minerals even when a user discharges water in a real time control mode and a method of controlling the same.

Technical Solution

The object of the present invention can be achieved by providing a method of controlling a drinking water supply device including allowing a user to input a water discharge signal through an input unit, opening a first valve such that drinking water flows through a first channel and measuring the amount of drinking water flowing through the first channel using a flow rate sensor, when the amount of drinking water measured by the flow rate sensor reaches a first predetermined amount, opening a second valve for a predetermined time to discharge minerals, when a water discharge end signal is not input by the user, remeasuring the flow rate of drinking water using the flow rate sensor and determining whether the remeasured flow rate of drinking water has reached a second predetermined amount, and, upon determining that the remeasured flow rate of drinking water has reached the second predetermined amount, opening the second valve again for the predetermined time to further discharge minerals.

The second predetermined amount may be the unit amount of drinking water that is set to be mixed with the minerals discharged for the predetermined time. The second predetermined amount may be greater than the first predetermined amount.

The sum of the first predetermined amount and the second predetermined amount may be the maximum amount of drinking water that is set to be mixed with the minerals discharged for the predetermined time. The number of times minerals are discharged may be equal to a value obtained by dividing the total amount of drinking water sensed by the flow rate sensor by the second predetermined amount.

The step of further discharging minerals may include further discharging minerals the same number of times as the number of times the remeasured flow rate of drinking water has reached the second predetermined amount. The input unit may include a lever configured to be pushed, the water discharge signal may be generated when the lever is pushed, and the water discharge end signal may be generated when a pushed state of the lever is released. The total amount of drinking water that is to be discharged may not be initially input but may be set at the time when the water discharge end signal is input.

In another aspect of the present invention, provided herein is a drinking water supply device including a first channel for guiding drinking water, the first channel being provided with a first valve for opening and closing the first channel and a flow rate sensor for sensing the flow rate of the drinking water, a water discharge channel connected to the rear end of the first channel for discharging the drinking water, a connection pipe connected between the first channel and the water discharge channel, a second channel for supplying minerals to the connection pipe, the second channel being provided with a second valve for opening and closing the second channel, a mineral container connected to the connection pipe via the second channel and disposed at the front end of the second vale for receiving condensed minerals, an input unit for generating a water discharge signal when a lever is pushed and generating a water discharge end signal when a pushed state of the lever is released, and a controller for, upon receiving the water discharge signal from the input unit and determining that the amount of drinking water measured by the flow rate sensor has reached a first predetermined amount, opening the second valve for a predetermined time to discharge minerals.

When the flow rate of drinking water is remeasured by the flow rate sensor and upon determining that the remeasured flow rate of drinking water has reached a second predetermined amount, the controller may open the second valve again for the predetermined time to further discharge minerals. The second predetermined amount may be the unit amount of drinking water that is set to be mixed with the minerals discharged for the predetermined time.

The sum of the first predetermined amount and the second predetermined amount may be the maximum amount of drinking water that is set to be mixed with the minerals discharged for the predetermined time. The second predetermined amount may be greater than the first predetermined amount.

Advantageous Effects

According to the present invention, it is possible to provide water having a uniform taste to a user even when the user continuously discharges the water in real time In the case in which the amount of water that is to be extracted is not initially input but is set later, it is difficult to determine when and how many minerals are to be mixed with water. According to the present invention, however, it is possible to uniformly maintain a ratio range of minerals in water. That is, according to the present invention, the deviation in ratio of minerals in mineral water to be supplied to the user may be reduced and the concentration distribution of the minerals is low, whereby water having a uniform taste may be provided to the user.

DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view showing the external appearance of a drinking water supply device according to an embodiment of the present invention;

FIG. 2 is a conceptual view showing the structure and pipe arrangement of the drinking water supply device according to the embodiment of the present invention;

FIG. 3 is a view schematically showing the construction of a mineral supply module according to an embodiment of the present invention;

FIG. 4 is a flowchart showing a method of controlling a drinking water supply device according to an embodiment of the present invention;

FIG. 5 is a view illustrating a situation in which an embodiment of the present invention is realized; and FIG. 6 is a view illustrating another situation in which an embodiment of the present invention is realized.

BEST MODE

Reference will now be made in detail to the preferred embodiments of the present invention, examples of which are illustrated in the accompanying drawings. Wherever possible, the same reference numbers will be used throughout the drawings to refer to the same or like parts. In the drawings, sizes and shapes of elements may be exaggerated or reduced for convenience and clarity of description.

In the following description, water that has yet to pass through a filter will be defined as raw water, raw water that has passed through a filter will be defined as clean water, and raw water or clean water containing minerals will be defined as mineral water. In addition, raw water and clean water may be defined as drinking water, which means water that a user may drink.

In addition, the front end and the rear end may mean the upstream side and the downstream side in the direction in which a fluid flows forward. The forward flowing direction is the direction in which drinking water flows in a drinking water supply device before the drinking water is discharged out of the drinking water supply device.

FIG. 1 is a perspective view showing the external appearance of a drinking water supply device according to an embodiment of the present invention. Referring to FIG. 1, a drinking water supply device 1 includes a cabinet 2, which forms the external appearance of the drinking water supply device 1, and a dispenser 3. The dispenser 3 is a space in which drinking water is supplied to a user. Consequently, the dispenser 3 is generally formed on the front of the cabinet 2.

The dispenser 3 may be provided with a cock (or spout) 73, through which drinking water is discharged. In addition, the dispenser 3 may also be provided with an input unit (or input lever) 4 for controlling the discharge of drinking water. The input unit 4 may be formed in the shape of a lever, which is pushed or pulled by the user.

The user may push or pull the input unit 4, which is formed in the shape of a lever. For example, the user may push or pull the lever, in the state in which the user has placed a cup C under the cock 73, to fill the cup C with drinking water discharged through the cock 73.

At this time, the drinking water supply device 1 may be operated in a real time control mode. In the real time control mode, the drinking water supply device 1 may be controlled to discharge drinking water through the cock 73 based on a time during which the user pushes or pulls the lever. That is, when the user manipulates the lever, the drinking water supply device 1 may be operated in the real time control mode.

Meanwhile, the drinking water supply device 1 may further include a mineral supply module (see FIGS. 2 and 3) for supplying minerals to drinking water that will be discharged from the drinking water supply device 1. That is, the drinking water supply device 1 may supply drinking water containing minerals, i.e. mineral water, to the user through the mineral supply module.

The drinking water supply device 1 may be further provided with a display unit (or display) 6 for showing a time when a mineral container provided in the mineral supply module is to be replaced or the like. Meanwhile, in the embodiment shown in FIG. 1, the drinking water supply device 1 is a stand-alone device. Alternatively, the drinking water supply device 1 may constitute part of another device, such as a refrigerator.

Hereinafter, the structure and pipe arrangement of the drinking water supply device, which is provided with a mineral supply module according to an embodiment of the present invention, will be described with reference to FIG. 2. FIG. 2 is a conceptual view showing the structure and pipe arrangement of the drinking water supply device according to the embodiment of the present invention.

Referring to FIG. 2, the drinking water supply device 1 according to the embodiment of the present invention may convert raw water, introduced into the drinking water supply device 1 through an external water tap 10, into clean water using a filter unit (or filter device) 20. The construction of the filter unit 20 may be variously changed. A plurality of single filters 21, 22, and 23 may constitute the filter unit 20. For example, the filter unit 20 may include a pre-carbon filter 21, an ultra-filtration (UF) filter 22, and a post-carbon filter 23.

When raw water is filtered by the filter unit 20 into clean water, the clean water may be discharged out of the drinking water supply device 1 through a clean water pipe 30, a clean water supply valve 32, and the cock 73. The drinking water supply device 1 may be configured to supply cold water or hot water according to the demand of the user.

Heated clean water, i.e. hot water, may be discharged out of the drinking water supply device 1 through a first branch clean water pipe 301, which diverges from point A of the clean water pipe 30, which is located at the rear end of the filter unit 20, a heating unit (or heater) 51, a hot water pipe 50, a hot water supply valve 52, and the cock 73. Cooled clean water, i.e. cold water, may be discharged out of the drinking water supply device 1 through a second branch clean water pipe 302, which diverges from a point that is further downstream than point A of the clean water pipe 30, a cooling unit (or cooler) 41, a cold water pipe 40, a cold water supply valve 42, and the cock 73.

For the convenience of description, an embodiment in which clean water, cold water, and hot water are discharged through a single cock 73 is shown in FIG. 2. Alternatively, cocks for discharging the clean water, the cold water, and the hot water may be provided separately. Additionally, the clean water and the cold water may be discharged through one cock, and the hot water may be discharged through another cock.

A cock valve (hereinafter, also referred to as a "first valve") 74 may be provided at the rear end (i.e. the downstream side) of the clean water supply valve 32, the cold water supply valve 42, and the hot water supply valve 52. The cock valve or first valve 74 may be connected to a distribution pipe 60. The distribution pipe 60 may be connected to the clean water pipe 30, the cold water pipe 40, and the hot water pipe 50.

A water discharge pipe 70, through which clean water, cold water, or hot water may be supplied, may be provided at the rear end of the cock valve 74. Consequently, clean water, cold water, or hot water may be supplied into the distribution pipe 60, and, when the cock 73 is opened by the single cock valve 74, the clean water, the cold water, or the hot water may be selectively supplied through the water discharge pipe 70.

Meanwhile, a mineral supply module 100 for supplying minerals to drinking water flowing in the water discharge pipe 70 may be connected to the water discharge pipe 70. The mineral supply module 100 may be connected to one side of the water discharge pipe 70 via a connection pipe 120, which is connected to the water discharge pipe 70. The connection pipe 120 may function as a mineral water generation unit, in which minerals are mixed with drinking water.

The water discharge pipe 70 may include a first channel 71 connected to the front end of the connection pipe 120 and a water discharge channel 72 connected to the rear end of the connection pipe 120. When the cock valve 74 is opened, clean water, cold water, or hot water may flow into the first channel 71 toward the cock 73, and may be introduced into the connection pipe 120 before the clean water, the cold water, or the hot water is discharged through the cock 73.

That is, the first channel 71 is disposed at the upstream side of the connection pipe 120 so as to supply drinking water, such as clean water, cold water, or hot water, to the connection pipe 120. The water discharge channel 72 is provided between the connection pipe 120 and the cock 73 so as to selectively discharge mineral water, generated in the connection pipe 120, through the cock 73.

The mineral supply module 100 may include a mineral container 140, a pump 160 for pressurizing the mineral container 140, a second channel 110 connected between the connection pipe 120 and the mineral container 140, and a mineral valve (hereinafter, also referred to as a "second valve") 130 provided in the second channel 110. The minerals supplied from the mineral supply module 100 to the connection pipe 120 may be a high concentration of condensed minerals.

In addition, the amount of minerals that are supplied from the mineral supply module 100 to the connection pipe 120 may be critical in determining the taste of the mineral water discharged through the cock 73. At this time, the amount of minerals that are supplied from the mineral supply module 100 to the connection pipe 120 may be much smaller than the flow rate of drinking water (i.e. clean water, cold water, or hot water) flowing in the connection pipe 120.

Consequently, the connection pipe 120 may be provided with a microchannel unit (or microchannel) 121. That is, condensed minerals may be supplied to the drinking water flowing in the connection pipe 120 through the microchannel unit 121. For example, the connection pipe 120 may be formed in a "T" shape. The connection pipe 120 may be provided with a mixing pipe 122 disposed between the first channel 71 and the water discharge channel 72 in the state of being parallel to the first channel 71 and the water discharge channel 72 and a microchannel unit 121 configured to supply condensed minerals to the mixing pipe 122 in the direction perpendicular to the mixing pipe 122.

Hereinafter, the concrete construction of the mineral supply module 100 and the structure in which minerals are supplied from the mineral supply module 100 to the water discharge pipe 70 will be described in detail with reference to FIG. 3. FIG. 3 is a view schematically showing the construction of a mineral supply module according to an embodiment of the present invention.

Hereinafter, reference numeral 74, which denotes the cock valve in the above description, will denote a first valve for the convenience of description. Referring to FIGS. 2 and 3 together, the drinking water supply device 1 according to the embodiment of the present invention may include a water discharge pipe 70, in which drinking water flows, a flow rate sensor 75 for sensing the flow rate of the drinking water, a connection pipe 120 defining a mineral supply line extending to one side of the water discharge pipe 70, a second channel 110 for supplying minerals to the connection pipe 120, a mineral container 140 for storing condensed minerals, and a pump 160 for pressurizing the mineral container 140.

The water discharge pipe 70 may be provided with a first channel 71 and a water discharge channel 72. The first channel 71 may be located further upstream than the water discharge channel 72. Specifically, the first channel 71 may be configured such that drinking water flows in the first channel 71, and the first channel 71 may be provided with a first valve 74 for selectively opening and closing the first channel 71.

The flow rate sensor 75 may be configured to sense the flow rate of the drinking water flowing in the water discharge pipe 70. More specifically, the flow rate sensor 75 may be configured to sense the flow rate of the drinking water flowing in the first channel 71 in real time.

The flow rate sensor 75 may be provided in the clean water pipe 30 at the rear end of the filter unit 20. Alternatively, the flow rate sensor 75 may be provided in the first channel 71. That is, the flow rate sensor 75 may be provided in a pipe or a channel located further upstream than the connection pipe 120 for sensing the flow rate of drinking water.

The water discharge channel 72 may be connected to the rear end of the first channel 71 for discharging drinking water. That is, drinking water may sequentially flow through the first channel 71 and the water discharge channel 72, and may then be discharged through the cock 73.

The connection pipe 120 may be connected between the first channel 71 and the water discharge channel 72. The connection pipe 120 may be formed in a "T" shape, and may be provided with a mixing pipe 122 for guiding the drinking water having passed through the first channel 71 to the water discharge channel 72 and a microchannel unit 121 defining a condensed mineral channel that extends to the mixing pipe 122 in the direction perpendicular to the mixing pipe 122.

When condensed minerals are guided to the mixing pipe 122, the pressure applied to the condensed minerals may be reduced while the condensed minerals pass through the microchannel unit 121. The cross-sectional diameter of the microchannel unit 121 may be less than the length of the microchannel unit 121. In addition, the cross-sectional area of the microchannel unit 121 may be less than the cross-sectional area of the mixing pipe 122. Consequently, it is possible to accurately control the amount of condensed minerals that are guided to the mixing pipe 122.

The second channel 110 may be configured to supply minerals (for example, condensed minerals) to the connection pipe 120. That is, the second channel 110 may be formed as a mineral supply pipe (or a mineral supply line).

One end of the second channel 110 in the longitudinal direction thereof may be connected to the connection pipe 120. More specifically, one end of the second channel 110 in the longitudinal direction thereof may be connected to the microchannel unit 121 of the connection pipe 120.

Consequently, the pressure at which condensed minerals are supplied through the second channel 110 may be reduced by the microchannel unit 121. That is, the microchannel unit 121 functions to reduce the pressure at which condensed minerals are supplied through the second channel 110. In addition, a second valve 130 may be provided in the second channel 110. The second valve 130 is configured to selectively open and close the second channel 110.

The mineral container 140 may be configured to store condensed minerals. In addition, the mineral container 140 may be connected to the connection pipe 120 via the second channel 110. That is, one end of the second channel 110 in the longitudinal direction thereof may be connected to the connection pipe 120, and the other end of the second channel 110 in the longitudinal direction thereof may be connected to the mineral container 140.

The pump 160 may pressurize the interior of the mineral container 140 in order to discharge the condensed minerals stored in the mineral container 140 from the mineral container 140. For example, the pump 160 may be an air pump. That is, the pump 160 may be an air pump that suctions external air and injects the suctioned air into the mineral container 140.

Consequently, the pump 160 may suction external air and inject the suctioned air into the mineral container 140 in order to increase the pressure in the mineral container 140. That is, when external air is injected into the mineral container 140 according to the operation of the pump 160, the condensed minerals stored in the mineral container 140 may be discharged out of the mineral container 140 due to the increase of the pressure in the mineral container 140.

At this time, the condensed minerals discharged out of the mineral container 140 may flow into the second channel 110. As a result, the pressure in the second channel 110 may be increased. In addition, the pressure in the mineral container 140 may be equal to the pressure in the second channel 110 since the interior of the mineral container 140 communicates with the second channel 110.

In addition, the mineral container 140 may be provided at the lower part thereof with an injection hole 141, through which external air is injected into the mineral container 140, and a discharge hole 142, through which the condensed minerals are discharged from the mineral container 140. Specifically, the condensed minerals stored in the mineral container 140 may be directed to the lower side of the mineral container 140 by gravity. The airtightness of the mineral container 140 may be improved since the injection hole 141 and the discharge hole 142 are formed at the lower part of the mineral container 140.

More specifically, the drinking water supply device 1 according to the embodiment of the present invention may further include a container fastening unit or fitting 150, which is fastened to the mineral container 140 at the lower side of the mineral container 140. The injection hole 141 and the discharge hole 142 may be formed at the lower end of the container fastening unit 150.

In addition, the container fastening unit 150 may be provided with an air injection channel 143, which communicates with the injection hole 141, and a mineral discharge channel 144, which communicates with the discharge hole 142. The injection hole 141 may communicate with the interior of the mineral container 140 through the air injection channel 143, and the discharge hole 142 may communicate with the interior of the mineral container 140 through the mineral discharge channel 144.

Since the pump 160, i.e. the air pump, is configured to inject air into the mineral container 140, it is necessary to maintain the airtightness of the mineral container 140 in order to discharge the required amount of condensed minerals from the mineral container 140. Since the mineral container 140 is disposed at the upper side of the container fastening unit 150, and the injection hole 141 and the discharge hole 142 are provided at the lower end of the container fastening unit 150, as described above, the airtightness of the mineral container 140 may be improved.

In addition, an air filter 161 may be provided at the air inlet side of the pump 160. The air filter 161 functions to filter impurities contained in the air injected into the mineral container 140 according to the operation of the pump 160. Here, the air filter 161 may be made of a hydrophobic member.

In addition, a check fitting or check valve 163 may be provided in a connection line 162 that connects between the pump 160 with the mineral container 140 (i.e. the container fastening unit 150). The check fitting or check valve 163 prevents minerals from flowing backward from the mineral container 140 to the pump 160. The reason for this is that the pump 160 may be damaged if minerals flow backward to the pump 160.

A pressure sensor 200 is provided in the second channel 110. The pressure sensor 200 may sense the pressure in the second channel 110. When the pump 160 is driven, air is injected into the mineral container 140. Since the second channel 110 communicates with the mineral container 140, the pressure in the mineral container 140 and the pressure in the second channel 110 are increased. As a result, the pressure sensed by the pressure sensor 200 is increased.

A drinking water supply device according to an embodiment of the present invention includes a first channel 71 for guiding drinking water, the first channel 71 being provided with a first valve 74 for opening and closing the first channel and a flow rate sensor 75 for sensing the flow rate of the drinking water, a water discharge channel 70 connected to the rear end of the first channel 71 for discharging the drinking water, a connection pipe 120 connected between the first channel 71 and the water discharge channel 70, a second channel 110 for supplying minerals to the connection pipe 120, the second channel 110 being provided with a second valve 130 for opening and closing the second channel, a mineral container 140 connected to the connection pipe 120 via the second channel 110 and disposed at the front end of the second vale 130 for receiving condensed minerals, an input unit 4 for generating a water discharge signal when a lever is pushed and generating a water discharge end signal when the pushed state of the lever is released, and a controller for, upon receiving the water discharge signal from the input unit 4 and determining that the amount of drinking water measured by the flow rate sensor 75 has reached a first predetermined amount, opening the second valve 130 for a predetermined time to discharge minerals.

FIG. 4 is a flowchart showing a method of controlling a drinking water supply device according to an embodiment of the present invention. Referring to FIG. 4, a user may input a water discharge signal, i.e. a water discharge start signal, through the input unit 4 by pushing the lever (S10). At this time, the user may push the lever rearward.

The controller 180 opens the first valve 74 such that drinking water flows through the first channel 71 (S20). The first valve 74 opens and closes the first channel 71. When the first valve 74 opens the channel, therefore, the drinking water may be discharged to the outside through the first channel 71.

The flow rate sensor 75 senses whether the flow rate of drinking water passing through the first channel 71 has reached a first predetermined amount (S30). Since the flow rate sensor 75 measures the flow rate of drinking water passing through the first channel 71, information about the flow rate of drinking water may be transmitted to the controller 180. When the first predetermined amount of drinking water is discharged through the first channel 71, the controller 180 opens the second valve 130 (S40).

At this time, the controller 180 opens the second valve 130 for a predetermined time and closes the second valve 130 after the lapse of the predetermined time (S50 and S60). The controller 180 may discharge a predetermined amount of minerals through the second valve 130. At this time, air pressure is generated through the pump 160. The air pressure is maintained uniform. When the second valve 130 is opened for the same predetermined time, therefore, it is possible to discharge the same amount of minerals every time.

It is determined whether a water discharge end signal has been input by the user (S70). The water discharge end signal may be generated when the pushed state of the lever is released. That is, the water discharge end signal may be input when the user separates a container, such as a cup, or his/her hand from the lever.

When the water discharge end signal is not input, the flow rate sensor 75 measures the first predetermined amount and then senses whether the measured flow rate has reached a second predetermined amount (S80). When the flow rate of drinking water measured by the flow rate sensor 75 has reached the second predetermined amount, the second valve 130 is opened to discharge minerals. At this time, the second valve may be open for the same predetermined time so as to discharge the same amount of minerals as the amount of mineral that has been previously discharged. When the water discharge end signal is input by the user, the controller 180 closes the first valve 74 so as to close the first channel 71 such that drinking water is no more discharged through the first channel 71.

The second predetermined amount may be greater than the first predetermined amount. The first predetermined amount is the amount at the time when the second valve 130 opens the channel to discharge minerals, and the second predetermined amount is the amount at the time when the second valve 130 further opens the channel to discharge minerals. Consequently, minerals may be discharged for the first time when the first predetermined amount of drinking water is discharged, and then minerals may be further discharged when the second predetermined amount of drinking water is discharged.

FIG. 5 is a view illustrating a situation in which an embodiment of the present invention is realized, and FIG. 6 is a view illustrating another situation in which an embodiment of the present invention is realized. In the following description given with reference to FIGS. 5 and 6, it is assumed that the first predetermined amount is 50 ml, the second predetermined amount is 120 ml, and the predetermined time is 1.3 seconds, for the convenience of description. However, the first predetermined amount, the second predetermined amount, and the predetermined time may be variously changed depending on various situations or a user's taste. Consequently, the present invention is not limited to the specific values.

FIG. 5 illustrates a situation in which minerals are discharged to drinking water extracted by the user once, unlike FIG. 6. Specifically, FIG. 5(*a*) illustrates a situation in which the user discharges an amount of drinking water that is greater than the first predetermined amount and less than the second predetermined amount, FIG. 5(*b*) illustrates a situation in which the user discharges an amount of drinking water that is equal to the second predetermined amount, and FIG. 5(*c*) illustrates a situation in which the user discharges an amount of drinking water that is greater than the second predetermined amount. In these situations, the same amount of minerals is discharged even though different amounts of drinking water are discharged to the user.

FIG. 5(*a*) shows the case in which the user inputs a water discharge signal, and discharges an amount of drinking water that is greater than 50 ml and less than 120 ml. The second valve 130 opens the second channel 110 to discharge minerals in the state in which the first predetermined amount, i.e. 50 ml, of drinking water has been discharged. That is, in the case in which the user discharges an amount of drinking water that is greater than 50 ml and less than 120 ml, minerals may be supplied for about 1.3 seconds at the time when 50 ml of drinking water is extracted.

FIG. 5(*b*) shows the case in which the user inputs a water discharge signal, and discharges an amount of drinking water that is equal to 120 ml. The second valve 130 opens the second channel 110 to discharge minerals in the state in which the first predetermined amount, i.e. 50 ml, of drinking water has been discharged.

Meanwhile, the second predetermined amount may be the unit amount of drinking water that is set to be mixed with the minerals discharged for the predetermined time. That is, the second predetermined amount may be a value that has already been set. The second predetermined amount may be a value optimized to a user's taste.

FIG. 5(*c*) shows the case in which the user inputs a water discharge signal, and discharges an amount of drinking water that is greater than 120 ml and less than 170 ml. The second valve 130 opens the second channel 110 to discharge minerals in the state in which the first predetermined amount, i.e. 50 ml, of drinking water has been discharged.

That is, the second valve 130 opens the channel when the measured flow rate has reached the first predetermined value, i.e. 50 ml, and the second valve 130 does not open the channel when the measured flow rate has not reached the second predetermined value, i.e. 120 ml. In conclusion, the second valve 130 opens the second channel 110 to discharge minerals when the measured accumulated data correspond to 50 ml or 170 ml.

Consequently, the sum of the first predetermined amount and the second predetermined amount may be the maximum amount of drinking water that is set to be mixed with the minerals discharged for the predetermined time. When drinking water is discharged within a range of the first predetermined amount, i.e. 50 ml, to the sum of the first predetermined amount and the second predetermined amount, i.e. 170 ml, minerals may be discharged once for the predetermined time. Consequently, mineral water containing a uniform ratio range of minerals may be supplied to the user, whereby water having a uniform taste may be provided to the user.

FIG. 6(*a*) shows the case in which the user manipulates the input unit 4 so as to discharge an amount of drinking water that is greater than 240 ml and less than 290 ml. In this case, the controller 180 opens the second valve 130 for a predetermined time (1.3 seconds) when the amount of drinking water that is equal to the first predetermined value, i.e. 50 ml, has been extracted, and opens the second valve 130 again when the amount of drinking water that is equal to the second predetermined value, i.e. 170 ml, has been extracted.

That is, when the amount of drinking water has reached the sum of the first predetermined value and the second predetermined value, the second valve 130 may be opened to discharge minerals. The number of times minerals are discharged is equal to the value obtained by dividing the total amount of drinking water sensed by the flow rate sensor by the second predetermined amount.

FIG. 6(*b*) shows the case in which the user manipulates the input unit 4 so as to discharge an amount of drinking water that is equal to 300 ml. Even in this case, the second valve 130 is opened so as to further discharge minerals the same number of times as the number of times the remeasured flow rate of drinking water has reached the second predetermined amount, in the same manner as in the previous case.

In this embodiment of the present invention, therefore, minerals in mineral water that is supplied to the user has a uniform range of concentration, whereby water may have a uniform range of taste regardless of the amount of mineral water that the user discharges. In this embodiment, even in the real time control mode, in which the total amount of drinking water that is to be discharged is not initially input but is set at the time when the water discharge end signal is input, water having a uniform range of taste may be provided to the user.

In the real time control mode, if minerals are discharged after the user discharges the unit amount, i.e. 120 ml, of drinking water, no minerals may be added when the user extracts 119 ml of drinking water. On the other hand, if minerals are supplied at the time when mineral water is discharged to the user, minerals may be discharged even when the user wishes to discharge a very small amount, e.g. 1 ml, of water, with the result that the concentration of the minerals in the mineral water is too high.

In this embodiment, therefore, minerals are supplied when drinking water is discharged by the flow rate positioned in front of the middle value, among the unit amounts of drinking water, whereby mineral water containing a uniform concentration range of minerals may be supplied to the user.

MODE FOR INVENTION

Various embodiments have been described in the best mode for carrying out the invention.

INDUSTRIAL APPLICABILITY

The present invention has the effect of providing a drinking water supply device that is capable of supplying mineral water containing a uniform ratio of minerals even when a user discharges water in a real time control mode and a method of controlling the same.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A method of controlling a drinking water supply device, the method comprising:

receiving a water discharge signal through a lever configured to be pushed, the water discharge signal being generated when the lever is pushed;

opening a first valve such that water flows through a first channel;

sensing a flow rate by a flow rate sensor to determine an amount of water flowing through the first channel;

opening a second valve to discharge minerals to be combined with the water when the amount of water reaches a first predetermined amount;

closing the second valve after a first predetermined amount of time to prevent discharge of minerals while the first valve is open for flow of water;

reopening the second valve to discharge minerals to be combined with the water when the amount of water reaches a second predetermined amount, the second predetermined amount being greater than the first predetermined amount; and closing the second valve after a second predetermined amount of time.

2. The method according to claim 1, further including reopening the second valve after an interval of the second predetermined amount, wherein the second predetermined amount is measured from the first predetermined amount, and the second predetermined amount is an amount of water that is set to be mixed with the minerals discharged for the second predetermined time at each interval of the second predetermined amount.

3. The method according to claim 2, wherein a number of times that the second valve is opened and minerals are discharged is equal to a value obtained by dividing a total amount of water sensed by the flow rate sensor by the second predetermined amount.

4. The method according to claim 1, wherein the opening of the second valve is repeated each time the flow rate sensor measures the second predetermined amount of water until the water discharge signal is interrupted.

5. The method according to claim 1, wherein a water discharge end signal is generated when a pushed state of the lever is released.

6. The method according to claim 5, wherein a total amount of water to be discharged is dictated by the water discharge end signal.

7. A drinking water supply device comprising:

a first channel through which water flows, the first channel including a first valve that opens and closes the first channel and a flow rate sensor that senses a flow rate of the drinking water through the first channel;

a water discharge channel connected downstream of the first channel and configured to discharge the water;

a connection pipe that connects the first channel to the water discharge channel;

a second channel through which minerals are supplied to the connection pipe, the second channel including a second valve that opens and closes the second channel;

a mineral container connected to the second channel and provided upstream of the second valve to receive minerals;

a lever configured to generate a water discharge signal when the lever is pushed and configured to generate a water discharge end signal when a pushed state of the lever is released; and a controller configured to open the second valve for a first predetermined time to discharge minerals upon receiving the water discharge signal and determining that an amount of water has reached a first predetermined amount and a second predetermined amount that is greater than the first predetermined amount.

8. The drinking water supply device according to claim 7, wherein the controller reopens the second valve for a second predetermined time to further discharge minerals when the amount of water has reached the second predetermined amount.

9. The drinking water supply device according to claim 7, wherein the second valve is reopened after an interval of the second predetermined amount, and the second predetermined amount is an amount of water that is set to be mixed with the minerals discharged for the second predetermined time after each interval of the second predetermined amount.

* * * * *